United States Patent [19]

Hotta

[11] 3,980,577

[45] Sept. 14, 1976

[54] DIPHENYLMETHANE ELECTROPHOTOGRAPHIC LIQUID DEVELOPER

[75] Inventor: Seiji Hotta, Hirakata, Japan

[73] Assignee: Sumitomo Chemical Company, Limited, Osaka, Japan

[22] Filed: Oct. 18, 1973

[21] Appl. No.: 407,486

[30] Foreign Application Priority Data

Oct. 21, 1972 Japan ..... 47-105661

[52] U.S. Cl. ..... 252/62.1 L; 427/15

[51] Int. Cl.[2] ..... G03G 9/00; G03G 13/00

[58] Field of Search ..... 252/62.1 L, 62.1 P; 427/15, 16

[56] References Cited

UNITED STATES PATENTS 3,325,409 6/1967 Whitbread et al. ..... 252/62.1

OTHER PUBLICATIONS

Metcalfe et al.; Fine Grain Development in Xerography; pp. 194, 195; Journal of Sci. Inst.[5/56].

The Color Index vol. 3 & 4, Third Ed. ('71) Soc. of Dyers & Colourists.

The Chemical Technology of Dyeing & Printing vol. 2 Reinhold 1951, p. 90.

The Chemistry of Synthetic Dyes & Pigm'ts –Lubs, Hafner Pub. Co., 1955.

*Primary Examiner*—David Klein

*Assistant Examiner*—L. V. Falasco

*Attorney, Agent, or Firm*—Stewart and Kolasch, Ltd.

[57] ABSTRACT

An electrophotographic developer containing a lake of a diphenylmethane color of the formula:

wherein $R_1$ and $R_3$ are each hydrogen, phenyl or alkyl substituted or unsubstituted with hydroxyl, alkoxy, cyano, carbalkoxy, carbamoyl or phenyl, $R_2$ and $R_4$ are each alkyl substituted or unsubstituted with hydroxyl, alkoxy, cyano, carbalkoxy, carbamoyl or phenyl and $R_5$ and $R_6$ are each hydrogen, alkoxy or halogen.

5 Claims, No Drawings

DIPHENYLMETHANE ELECTROPHOTOGRAPHIC LIQUID DEVELOPER

The present invention relates to an electrophotographic developer.

As is well known, various types of electrophotography have been developed, and the basic processes which are common to them comprise applying corona discharge to a photoconductive layer bonded to a suitable support thereby producing an overall uniform distribution of electrical charges on the layer, exposing the layer to a light pattern thereby forming an electrostatic latent image, producing a visible image of the electrical charge pattern with a developer, and then, if necessary, applying a suitable fixing treatment to the visible image.

The present invention relates to developers, particularly liquid type yellow developers suitable for use in such processes.

The conventional yellow developers contain, as a color component, a monoazo yellow such as Hansa Yellow, a disazo yellow such as Benzidine Yellow, oil yellow or lead chromate. However, they have the following disadvantages. Monoazo yellow type colors have a low color value. Disazo yellow type colors carry charges which are electrically unstable and tend to change with the lapse of time in a carrier liquid, and so frequently produce a developer carrying both positive and negative charges. Furthermore, these color types have a common disadvantage that they tend to be negatively charged, for example, they are negatively charged in their liquid dispersions in an alkyd resin to cause a gel-formation and a phase-separation followed by pigment settlement in the concentrated dispersions. Oil yellow type colors have a low color value, and often cause flowing of a developed image. Lead chromates are very unsuitable for this purpose because they have less transparency, and an extremely low stability of their toner liquors which results in a marked pigment settlement. Among these colors, disazo yellow type colors are relatively desirable, however they disadvantageously cause an irregularity of the electrostatic latent image of a color to be superimposed thereon in a multiple-development for color prints due to their high insulating property of the visible images of the yellow colors which inhibits leakage of the surface charges in an illuminated area and, accordingly quite a different image from the original pattern is produced.

An object of the present invention is to provide a yellow developer entirely free from the disadvantages as mentioned above, having a high color value, a desirable charge state where positive and negative charges are not mixed, an outstanding stability of its toner liquors and an excellent tone of image reproduction.

For the accomplishment of this object, the present invention provides an electrophotographic developer containing a carrier, a resinous, waxy or varnish substance, and a lake of a diphenylmethane color of the formula (I):

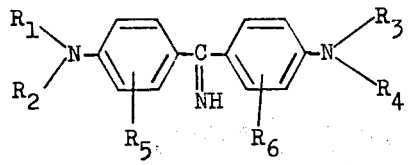

(I)

wherein $R_1$ and $R_3$ are each hydrogen, phenyl or alkyl substituted or unsubstituted with hydroxyl, alkoxy, cyano, carbalkoxy, carbamoyl or phenyl, $R_2$ and $R_4$ are each alkyl substituted or unsubstituted with hydroxyl, alkoxy, cyano, carbalkoxy, carbamoyl or phenyl and $R_5$ and $R_6$ are each hydrogen, alkoxy or halogen, and also provides a process for developing an electrostatic image on a base material, which comprises applying the developer of the present invention to a surface carrying a negatively charged electrostatic image for forming a visible image on said surface.

In the present invention, the terms "alkyl" and "alkoxy" are intended to mean an alkyl having 1 to 8 carbon atoms and an alkoxy having 1 to 4 carbon atoms, respectively.

The diphenylmethane type colors of the formula (I) which are particularly suitable for use in the present invention are exemplified as follows:

| No. | Formula |
|---|---|
| 1 | 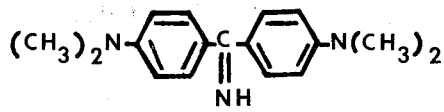 |
| 2 | 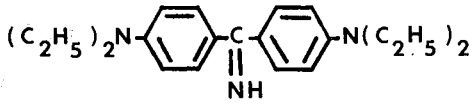 |
| 3 | 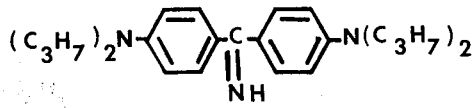 |
| 4 | 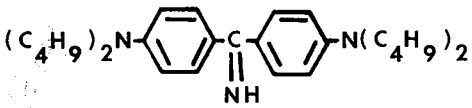 |
| 5 | 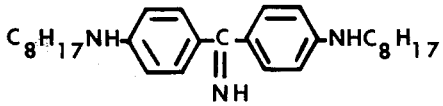 |
| 6 | 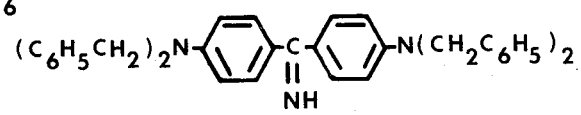 |
| 7 | 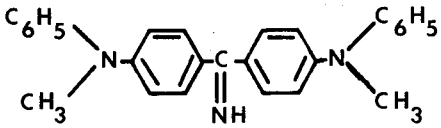 |
| 8 | 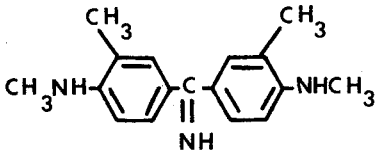 |

| No. | Formula |
|---|---|
| 9 | 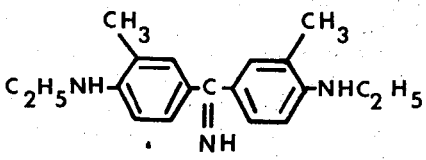 |
| 10 | 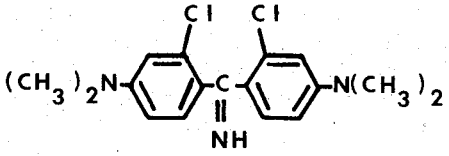 |
| 11 | 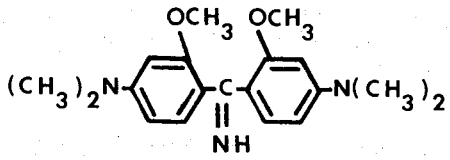 |
| No. | Formula |
|---|---|
| 12 | 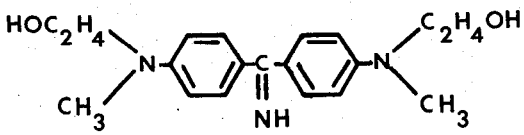 |
| 13 | 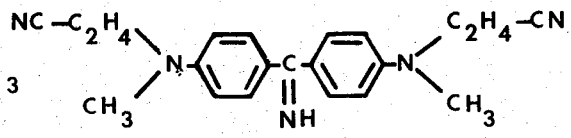 |
| 14 | 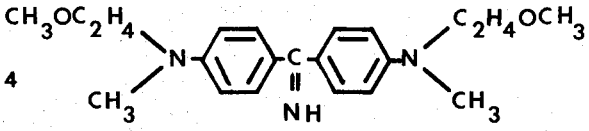 |
| 15 | 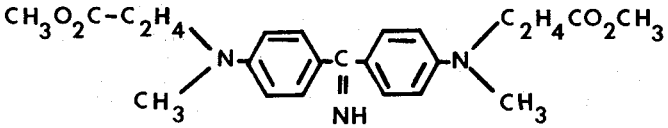 |
| 16 | 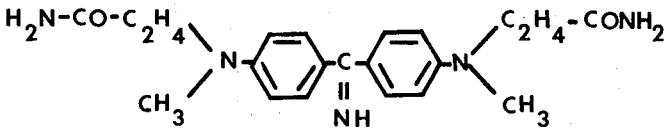 |
| 17 | 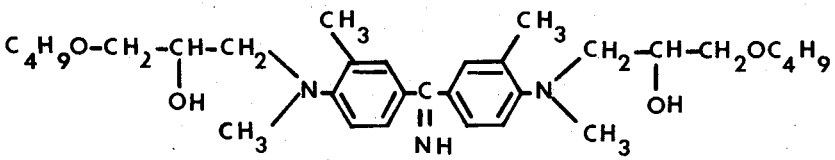 |
| 18 | 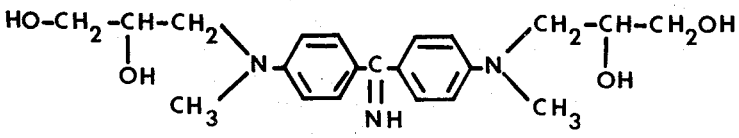 |
| 19 | 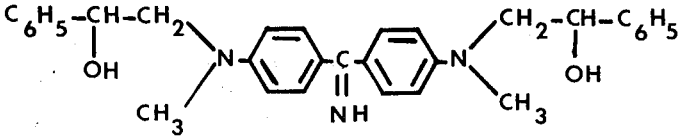 |
| 20 | 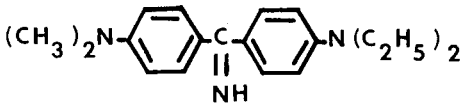 |
| 21 | 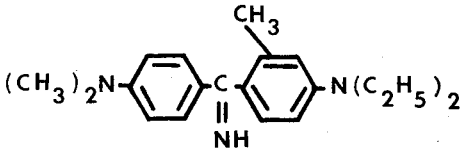 |

These diphenylmethane colors can be prepared by the conventional methods, for example, by condensing a corresponding N-substituted or N,N-disubstituted aniline with formalin to produce a methylene bis(N-substituted or N,N-disubstituted aniline), and heating the resultant compound in sulfur with ammonia and sodium chloride, or by heating a corresponding N-substitued or N,N-disubstituted benzophenone together with ammonia and zinc chloride.

Precipitants for the lake-formation include tannic acid, gallic acid, silicomolybdic acid, phosphomolybdic acid, phosphotungstic acid and phosphotungstomolybdic acid.

The lakes of the colors of the formula (I) can be prepared using the above precipitants by the conventional methods well known to those skilled in the art. For example, the lakes can be obtained by mixing an aqueous acetic acid solution of the colors of the formula (I), or a mineral acid or organic acid salt thereof, and an aqueous solution of the above precipitants to form the lakes as precipitates which are then filtered and washed.

The electrophotographic developer of the present invention can be prepared by dispersing the lakes thus prepared in a high electrical resistivity liquid, preferably having above $10^{10}\Omega$.cm of volume resistivity, and mixing the resulting dispersion with an additive agent such as a control agent to modify the charge or surfactant if necessary, and a resinous or waxy substance.

The dispersion may be effected using the conventional dispersing apparatus such as a ball mill, roller mill and the like according to the same manner as in the preparation of paint and ink.

The high electrical resistivity liquids, namely carrier liquids, include aliphatic, alicyclic and halogen-substituted hydrocarbons, such as normal paraffin, isoparaffin, ligroin, kerosene, cyclohexane, chlorinated hydrocarbons, and chlorinated and fluorinated hydrocarbons, more concretely, Shellsol 71 (isoparaffin, a registered trademark of Shell Petroleum Co., Ltd.), Isopar H and Isopar G (isoparaffin, a registered trademark of Esso Co., Ltd.), and trichlorotrifluoroethane.

The additive agents such as a control agent to modify the charge, surfactant and the like include polyvalent metal salts of organic acids including naphthenic acid, stearic acid and oleic acid, for example, calcium naphthenate, cobalt naphthenate, manganese naphthenate, aluminum naphthenate, zinc naphthenate, zirconium naphthenate, copper naphthenate, iron naphthenate, cobalt oleate and aluminum stearate.

The resins, waxy or varnish substances include an oil-modified alkyd resin, rosin-modified phenolformaldehyde resin, polyhydric alcohol ester of hydrogenated rosin, polyaryl or polymethacryl ester resin, polyvinyl acetate and polystyrene.

The substances which are used in the present invention are particularly preferably a uniform mixture of vegetable oils and alkyl phenolic resins belonging to an oil-soluble phenolic resin, or a varnish which is a precondensate or poly-condensate of said resins and oils. The alkyl phenolic resins may be either a novolak type or a resol type.

The vegetable oils include linseed oil, tung oil, soybean oil and rape-seed oil. The varnishes are prepared by the conventional methods.

The developers of the present invention hold positive charges in a stable state, and impart an attractive development and repulsive development when applied to a negatively charged and positively charged electrostatic latent image, respectively. In either development, the present developers can produce a visible image of excellent tone reproduction and high color value.

The present invention will be illustrated with reference to the following examples, which are only given for the purpose of illustration and are not to be interpreted as limiting. Unless otherwise mentioned, all parts in the examples are by weight.

EXAMPLE 1

The materials used for the preparation of a dispersion were as follows:

| | |
|---|---|
| Phosphotungstomolybdic acid lake of the color of the following formula | 20 parts |

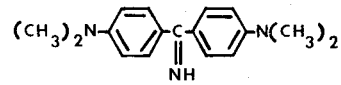

(C.I. Basic Yellow 2)

| | |
|---|---|
| Rosin-modified phenol-formaldehyde resin | 50 parts |
| Linseed oil varnish | 30 parts |
| Isopar G | 320 parts |

These materials were milled together in a ball mill for 20 hours to prepare a concentrated dispersion of developer. Five parts by volume of the concentrate thus obtained were diluted with 500 parts by volume of Isopar G, and then 3 parts by volume of a 2 % aluminum stearate solution were added thereto to make a developer. The developer was applied to development of the negatively charged electrostatic latent image on a zinc oxide sensitive paper. The yellow picture thus obtained was of a high color value, excellent tone reproduction and free from a flowing phenomenon (a tailing of the color from the picture during development and air-drying). The developer was stable and caused no pigment settlement even after 10 days, and gave a print of the same high color value as with the freshly prepared developer.

EXAMPLE 2

The mixture of the following composition was milled in a ball mill for 16 hours to obtain a liquid concentrate of developer:

| | |
|---|---|
| The same phosphotungstomolybdic acid lake of the diphenylmethane color as in Example 1 | 10 parts |
| Varnish | 40 parts |
| Isopar H | 200 parts |

The varnish used was a polycondensate between 100 % phenolic resin (Superbeckacite 1001, a registered trademark of Dainihon Ink Co., Ltd.) and linseed oil which was condensed at 180°C for 1 hour. The concentrate thus obtained was further diluted 100 times by volume with Isopar H to make a developer. The dispersion stability of the developer was checked on a settlement test. The comparative test results between the above developer and a developer containing a well known disazo yellow pigment are as shown in Table 1.

Table 1

| Developer | Retention time[1] |
|---|---|
| Present liquid developer | More than 10 days |
| Liquid developer I[2] (control) | 30 minutes |
| Liquid developer II[3] (control) | 8 hours |

Note:
[1]A period during which the developer was maintained in a complete dispersion state.
[2]A dispersion of Finess Yellow GT (Toyo Ink Co., Ltd.) in an alkyd resin.
[3]A dispersion of Seika Fast Yellow 2400 (Dainichi Seika Co., Ltd.) in a polycondensated varnish between phenolic resin and soy-bean oil.

It can be seen from Table 1 that the liquid developer of the present invention is superior to others in the dispersion stability.

Next, the adaptability of the developer to a multicolor development was checked on the determination of a trapping ratio (overtrapping effect). The results are as shown in Table 2.

Table 2

| Developer | Trapping ratio | Cyan* color superimposed on yellow plus magenta** (%) | Yellow color superimposed magenta** plus cyan* (%) |
|---|---|---|---|
| Present liquid developer[1] | | 92 | 90 |
| Liquid developer I[2] (control) | | 70 | 70 |
| Liquid developer II[3] (control) | | 65 | 65 |

Note: [1], [2] and [3], same as in Table 1.
*C.I. Pigment Blue 15
**C.I. Pigment Red 81

The results show that the present developer has a higher trapping ratio.

The trapping ratio is the value calculated according to the following formula:

Trapping ratio $= A - B/C \times 100$ (%)

*A:* Density of the finished color

*B:* Density of the lower color

*C:* Density of the upper color superimposed on the lower color

Each density was determined on a Mac Beth densitometer using a complementary filter of the upper color.

EXAMPLE 3

The mixture of the following composition was milled in a ball mill for 16 hours to obtain a liquid concentrate of developer.

| | |
|---|---|
| The same phosphotungstomolybdic acid lake of the diphenylmethane color as in Example 1 | 10 parts |
| Varnish | 40 parts |
| Isopar H | 200 parts |

The varnish used was a polycondensate between 100 % phenolic resin (Tamanol 528, a registered trademark of Arakawa Rinsan Co., Ltd.) and soy-bean oil which was condensed at 230°C for 1 hour. The concentrate was further diluted 100 times by volume with Isopar H to make a yellow developer. The overtrapping effect of the developer was checked by first producing a yellow image pattern with the developer and then superimposing a magenta developer containing an alkyd resin as a major component on the yellow pattern. The red image pattern thus obtained gave 90 % of trapping ratio.

EXAMPLE 4

The materials used for the prepration of a dispersion were as follows:

| | |
|---|---|
| Phosphotungstomolybdic acid lake of the color of the following formula | 20 parts |

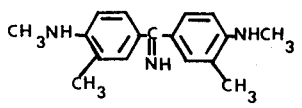

(C.I. Basic Yellow 3)

| | |
|---|---|
| Oil-modified alkyd resin | 80 parts |
| Isopar G | 320 parts |

These materials were milled together in a ball mill for 20 hours to prepare a liquid concentrate of developer. Five parts by volume of the concentrate thus obtained were diluted with 500 parts by volume of Isopar G, and then 3 parts by volume of a 2 % zirconium naphthenate solution were added thereto to make a developer. The developer was applied to development of the negatively charged electrostatic latent image on a zinc oxide sensitive paper. The yellow picture thus obtained was of a high color value, and free from fogging and flowing. Furthermore, though the developer was used repeatedly for development, it gave correct prints and high color values constantly.

EXAMPLE 5 (Example of three-color printing)

The superiority of the present developer was confirmed by a positive-to-positive reproduction as follows. A zinc oxide sensitive paper having photosensitivity throughout the range of the visible spectrum was negatively charged, exposed through a combination of a colored positive film and a blue filter, the filter being closer to the paper, developed with the yellow developer prepared in Example 1, and then dried. The developed paper was treated two more times in the same manner as described above, except that the first operation used a green filter and a magenta developer in place of the blue filter and the yellow developer, respectively, and that the second operation used a red filter and a cyan developer. The magenta and cyan developers were prepared according to Example 1, using Rhodamine lake pigment and phthalocyanine blue pigment, respectively. The colored positive picture thus obtained gave a well-reproduced picture of the original pattern.

In the process, a colored positive picture was prepared in the same manner as above, except that a developer containing disazo yellow type pigment was used in place of the developer prepared in Example 1. It was observed from the result that the magenta and cyan developers showed an abnormal overtrapping in the development process thereby producing a completely different colored positive picture from the original pattern.

What is claimed is:

1. An electrophotographic liquid developer comprising (1) a carrier liquid having above $10^{10}\Omega$ cm of volume resistivity, (2) a resinous, waxy or varnish substance selected from the group consisting of oil-modified alkyd resins, rosin-modified phenolformaldehyde resins, polyhydric alcohol esters of hydrogenated rosins, polyacryl ester resins, polymethacryl ester resins, polyvinyl acetate and polystyrene, and (3) a lake of the diphenylmethane C.I. Basic Yellow No. 2 or No. 3 having, respectively, the following formulae:

Yellow No. 2:

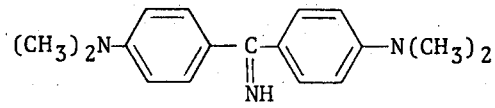

Yellow No. 3:

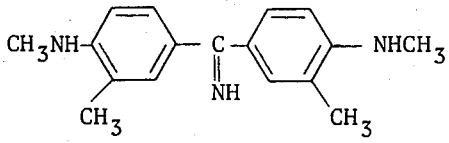

2. The developer according to claim 1, wherein the diphenylmethane color is

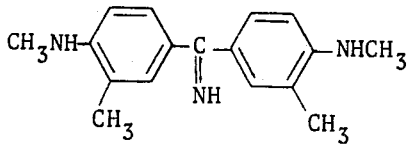

3. The developer according to claim 1, wherein the diphenylmethane color is

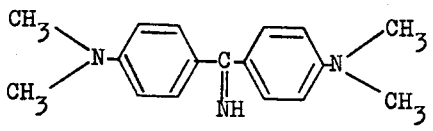

4. The developer according to claim 1, wherein the lake is a member selected from the group consisting of tannic acid, gallic acid, silicomolybdic acid, phosphomolybdic acid, phosphotungstic acid and phosphotungstomolybdic acid lakes.

5. A process for preparing the electrophotographic developer of claim 1, which comprises dispersing the lake defined in claim 1 in said carrier and mixing the resulting dispersion with said resinous, waxy or varnish substance.

* * * * *